US006939194B2

(12) United States Patent
Bapst et al.

(10) Patent No.: US 6,939,194 B2
(45) Date of Patent: Sep. 6, 2005

(54) INFANT SUPPORT STRUCTURE AND METHOD OF USING THE SAME

(75) Inventors: David M. Bapst, South Wales, NY (US); John S. Canna, Orchard Park, NY (US); Maarten Van Huystee, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/268,911

(22) Filed: Oct. 11, 2002

(65) Prior Publication Data

US 2004/0082261 A1 Apr. 29, 2004

(51) Int. Cl.[7] ..... A63H 33/00
(52) U.S. Cl. ..... 446/227
(58) Field of Search ..... 446/227; 472/29; D21/830

(56) References Cited

U.S. PATENT DOCUMENTS

| | | | | | |
|---|---|---|---|---|---|
| 1,453,942 | A | | 5/1923 | Mills | |
| 1,574,226 | A | | 2/1926 | Ackermann | |
| 2,087,537 | A | * | 7/1937 | Finkel | 362/102 |
| 2,477,027 | A | | 7/1949 | Wenberg | |
| 2,478,445 | A | | 8/1949 | Yurkovich | |
| 2,681,659 | A | | 6/1954 | Hrinsin | |
| 2,993,216 | A | | 7/1961 | Casey | |
| 4,214,808 | A | * | 7/1980 | Hampson | 359/616 |
| 4,365,819 | A | * | 12/1982 | Bart | 280/47.41 |
| 4,825,484 | A | | 5/1989 | Riegel | |
| 4,848,385 | A | | 7/1989 | Pennella | |
| 4,939,582 | A | | 7/1990 | Holdredge et al. | |
| 4,978,166 | A | | 12/1990 | James | |
| 5,053,931 | A | * | 10/1991 | Rushing | 362/102 |
| 5,072,462 | A | * | 12/1991 | Attison | 5/600 |
| 5,073,825 | A | | 12/1991 | Holdredge et al. | |
| 5,083,837 | A | | 1/1992 | Roach | |
| 5,148,356 | A | | 9/1992 | Freese et al. | |
| 5,206,733 | A | * | 4/1993 | Holdredge et al. | 348/836 |
| 5,331,524 | A | * | 7/1994 | Tseng | 362/102 |
| 5,613,757 | A | | 3/1997 | Polk | |
| 5,660,435 | A | | 8/1997 | Eichhorn | |
| 5,730,638 | A | | 3/1998 | Ward | |
| 5,947,552 | A | | 9/1999 | Wilkins et al. | |
| 6,027,163 | A | | 2/2000 | Longenecker | |
| 6,068,006 | A | * | 5/2000 | Murphy | 135/16 |
| 6,072,606 | A | | 6/2000 | Huether et al. | |
| 6,095,614 | A | | 8/2000 | Canna et al. | |
| 6,126,233 | A | | 10/2000 | Gaetano et al. | |
| 6,149,489 | A | | 11/2000 | Johnson | |
| 6,186,640 | B1 | | 2/2001 | Typaldos | |
| 6,247,755 | B1 | | 6/2001 | Canna et al. | |
| 6,257,659 | B1 | | 7/2001 | Wilkins et al. | |
| 6,390,555 | B2 | | 5/2002 | Wilkins et al. | |
| 6,434,768 | B2 | | 8/2002 | Brown et al. | |
| 6,464,594 | B1 | * | 10/2002 | Canna et al. | 472/119 |
| 6,578,214 | B2 | * | 6/2003 | Peftoulidis | 5/308 |
| 6,848,966 | B2 | | 2/2005 | Wells | |
| 2003/0201662 | A1 | * | 10/2003 | Armbruster et al. | 297/295 |
| 2004/0031827 | A1 | * | 2/2004 | Haber | 224/160 |

FOREIGN PATENT DOCUMENTS

GB 2 200 541 A 8/1988

OTHER PUBLICATIONS http://www.nps.gov/glec/caro/carousel.htm.*

* cited by examiner

*Primary Examiner*—Derris H. Banks
*Assistant Examiner*—Ali Abdelwahed
(74) *Attorney, Agent, or Firm*—Cooley Godward LLP

(57) ABSTRACT

An infant support structure that may be used to entertain and/or pacify an infant. The infant support structure includes an entertainment device.

40 Claims, 3 Drawing Sheets

INFANT SUPPORT STRUCTURE AND METHOD OF USING THE SAME

BACKGROUND OF THE INVENTION

This invention relates generally to an infant support structure, and in particular, to an infant support structure that produces audible and/or visual outputs.

Conventional support structures may be used to pacify and relax infants. Some conventional support structures include an entertainment component that provides entertainment to an infant on the support structure. Some entertainment components include some form of output. The outputs can be used to attract the attention of and/or pacify an infant on the support structure. For example, some entertainment components may include an output system that generates an audible output or a visual output.

However, many conventional support structures do not provide outputs that retain the interest of an infant on the support structure. Accordingly, infants quickly become disinterested in conventional support structures.

A need exists for a support structure that generates outputs that are interesting to an infant on the support structure.

SUMMARY OF THE INVENTION

The present invention relates to an infant support structure that may be used to entertain and/or pacify an infant. In one embodiment, the infant support structure is a bassinet. In other embodiments, the infant support structure is any support structure that can support an infant.

The infant support structure includes an entertainment device. In one embodiment, the entertainment device includes an output generating system. The output generating system is connected to several output mechanisms that generate various outputs. For example, in one embodiment, the output generating system includes a sound generating system that generates audible outputs such as music and/or sound effects. In another embodiment, the output generating system includes an illumination device or light source that illuminates a portion of the support structure. In another embodiment, the output generating system includes a vibrating mechanism that imparts vibrations to the support structure.

DETAILED DESCRIPTION OF THE INVENTION

The present invention relates to an infant support structure that may be used to entertain and/or pacify an infant. In one embodiment, the infant support structure is a bassinet. In other embodiments, the infant support structure is any support structure that can support an infant.

The infant support structure includes an entertainment device. In one embodiment, the entertainment device includes an output generating system. The output generating system is connected to several output mechanisms that generate various outputs. For example, in one embodiment, the output generating system includes a sound generating system that generates audible outputs such as music and/or sound effects. In another embodiment, the output generating system includes an illumination device or light source that illuminates a portion of the support structure. In another embodiment, the output generating system includes a vibrating mechanism that imparts vibrations to the support structure.

Figure 1:
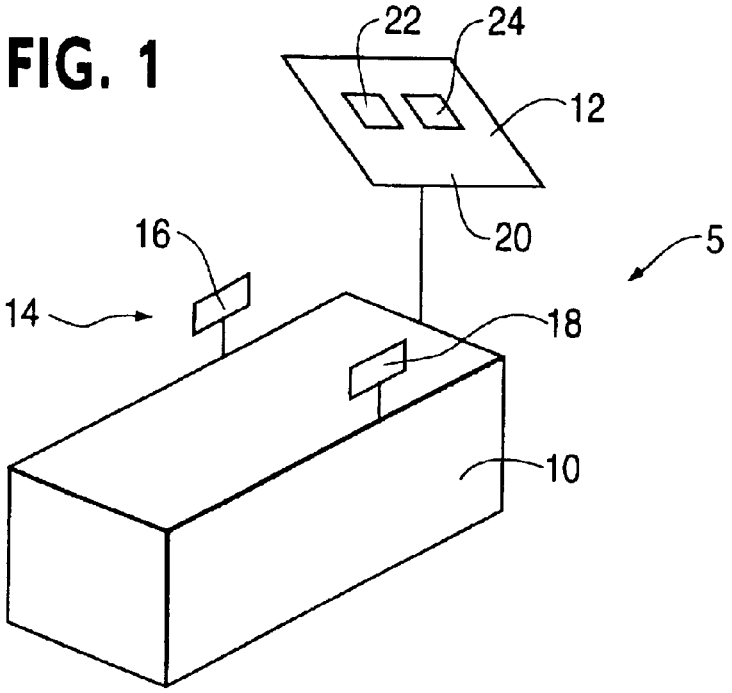
FIG. 1 illustrates a schematic view of an infant support structure according to the present invention.

A schematic view of an embodiment of an infant support structure according to the present invention is illustrated in FIG. 1. In the illustrated embodiment, the infant support structure 5 includes a frame or support 10 and a display portion 12. The display portion 12 is movably coupled to the frame 10 and disposable in several positions relative to the frame 10. In alternative embodiments, the display portion 12 can be releasably or fixedly coupled to the frame 10.

In one embodiment, the infant support structure 5 is a bassinet. In other embodiments, the infant support structure 5 can be any type of support structure on which an infant can be supported. For example, the infant support structure 5 can be a high chair, bouncer, swing, play yard, bed, etc.

The display portion 12 can be any surface or structure that can be positioned relative to the frame 10 to provide a visual display to an infant supported by the infant support structure 5. The display portion 12 is a flexible structure, such as a fabric canopy. In other embodiments, the display portion can be any semi-rigid or rigid structure that can be positioned relative to the frame 10. The display portion can be alternatively referred to as a display component, a display or background portion, and a cover.

The infant support structure 5 includes an output generating system 14 that provides audible and/or visual outputs. In the illustrated embodiment, the output generating system 14 includes light generating mechanisms 16 and 18. Each of the light generating mechanisms 16 and 18 includes a light source that generates light. The light source can be a grain of wheat (GOW) lamp, a bulb or an LED. Each light source is configured and oriented to shine light on the display portion 12. While two light generating mechanisms are illustrated in FIG. 1, any number of light generating mechanisms can be provided for the infant support structure 5.

In the illustrated embodiment, the display portion 12 includes a display surface 20 that is configured to be viewed by an infant on the infant support structure 5. In one embodiment, the display surface 20 is made from a non-reflective material. The display portion 12 includes reflectors or reflective surfaces 22 and 24 that are disposed on the display surface 20. Light from light generating mechanisms 16 and 18 is directed toward reflectors 22 and 24. The reflectors 22 and 24 reflect the light and produce visual images that can be viewed by the infant.

Figure 2:
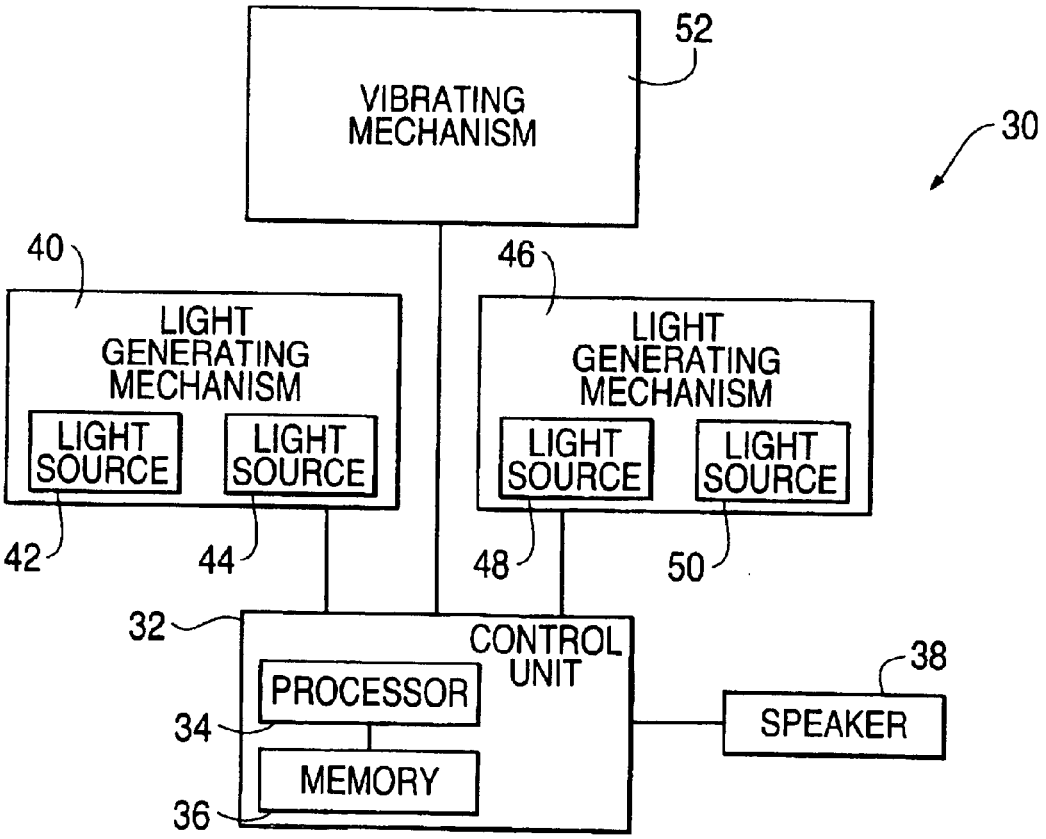
FIG. 2 illustrates a schematic view of an output generating system according to the present invention.

An embodiment of an output generating system according to the present invention is illustrated in FIG. 2. The output generating system 30 includes several output components that are used to entertain and/or relax an infant. In the illustrated embodiment, the output components include an audio output device or speaker 38, light generating mechanisms 40 and 46, and a vibrating mechanism 52. In alternative embodiments, the output generating system can include any combination of these output components.

The output generating system 30 includes a control unit 32 that includes a processor 34 and an associated memory 36. The processor 34 can be any conventional processor. For example, the processor can be a Sonix Model No. SN66060.

The processor 34 is connected to the audio output device 38, the light generating mechanisms 40 and 46, and the vibrating mechanism 52. Audible outputs such as music and sound effects are stored in memory 36 and can be output via the audio output device 38. The output generating system 30 also includes a power source (not shown) such as batteries, an on/off power switch, and a mode switch that allows a user to select between different modes of operation.

Light generating mechanism 40 includes a first light source 42 and a second light source 44. Light sources 42 and 44 are oriented to direct light outwardly from the light generating mechanism 40. Similarly, light generating mechanism 46 includes a first light source 48 and a second light source 50. Light sources 48 and 50 are oriented to direct light outwardly from the light generating mechanism 46. In the illustrated embodiment, each light source is a GOW lamp. In alternative embodiments, each light source can be a bulb, an LED, or other light producing device.

The processor 34 is configured to control the operation of the light sources of the light generating mechanisms 40 and 46 and the output of the speaker 38. In one embodiment, the light sources can be illuminated in coordination or synchronously with the audible outputs generated by the speaker 38. As discussed in detail below, the infant support structure 5 has several different modes of operation in which different audible and visual outputs are generated.

The vibrating mechanism 52 is a conventional vibrating mechanism that is coupled to the support structure 5. The vibrating mechanism 52 can be coupled to the frame 10 at any location, for example, the front of the frame 10. A user can control the vibrating mechanism 52 via a switch on the control unit. In one embodiment, the vibrating mechanism 52 can be operated at several different frequencies.

Figure 3:
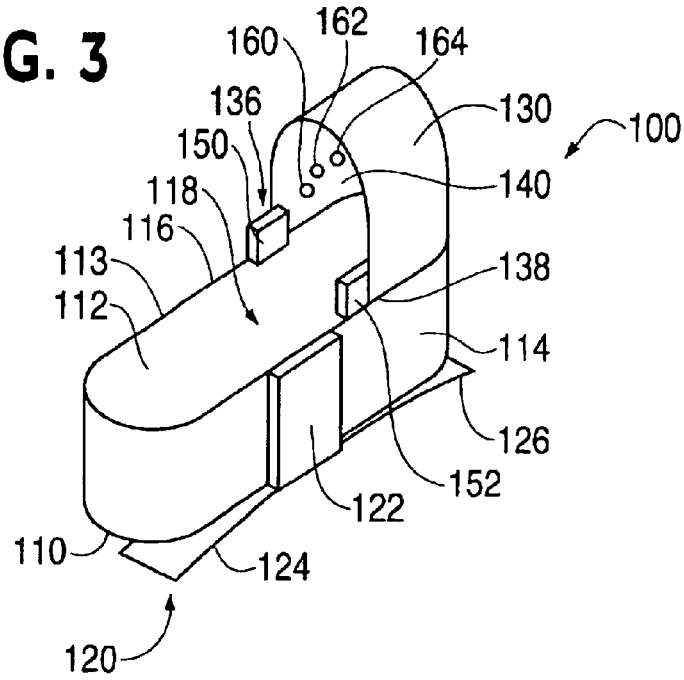
FIG. 3 illustrates an assembled perspective view of an embodiment of an infant support structure according to the present invention.
Figure 4:
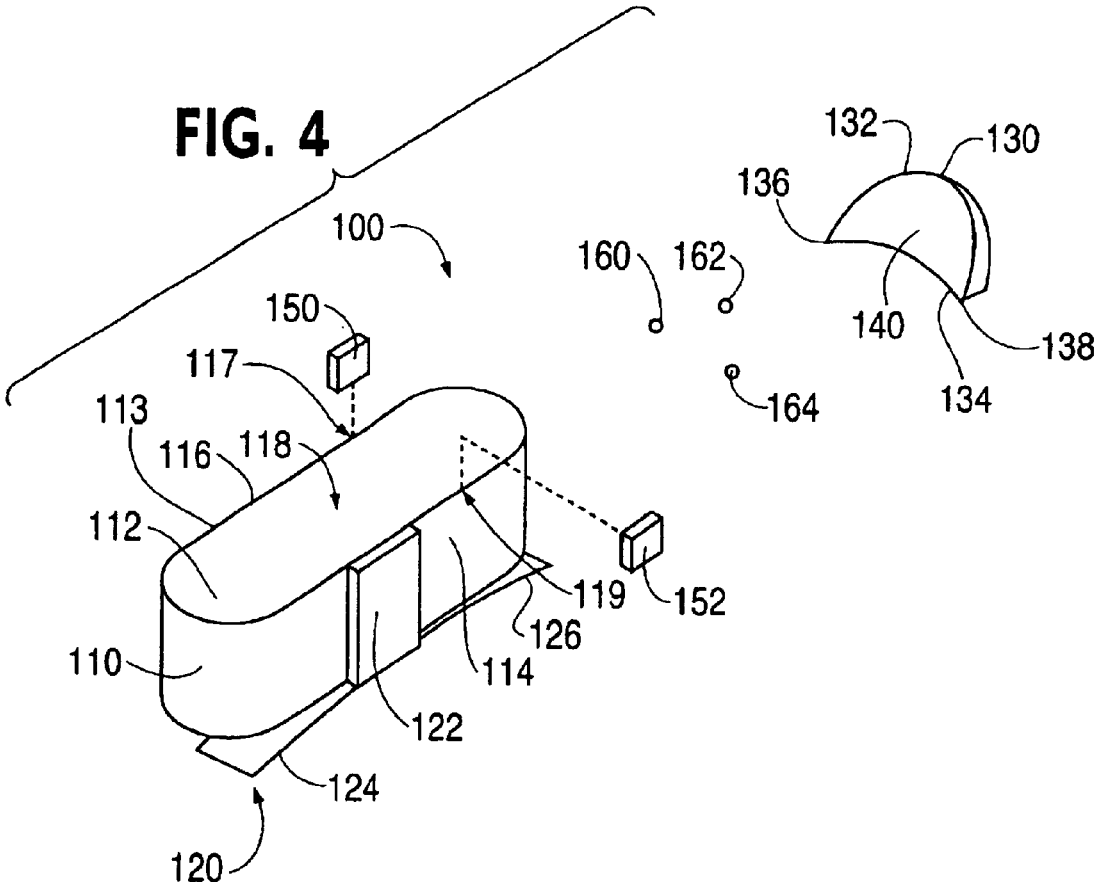
FIG. 4 illustrates an exploded perspective view of the infant support structure of FIG. 3.

An embodiment of an infant support structure is illustrated in FIGS. 3 and 4. In this embodiment, infant support structure 100 is an infant bassinet. In alternative embodiments, the infant support structure 100 can be any type of support structure on which an infant can be supported as previously described.

As illustrated in FIG. 3, the infant support structure 100 includes a support 110 that is coupled to a frame 120. The frame 120 can be placed on a support surface to retain the support 110 out of contact from the support surface.

The frame 120 includes a hub 122 that is coupled to the support 110. The frame also includes legs 124 and 126 that are substantially U-shaped. One end of each leg 124 and 126 is pivotally coupled to the hub 122. The other end of each leg 124 and 126 is pivotally coupled to another hub (not shown) that is coupled to the support 110 on the opposite side of the support 110.

The legs 124 and 126 are disposable in multiple positions relative to the hubs. For example, the legs 124 and 126 can be disposed and retained in deployed or extended positions as illustrated in FIGS. 3 and 4. The legs 124 and 126 can also be disposed and retained in collapsed positions in which the legs 124 and 126 are substantially parallel to each other and extend upwardly from the hubs.

In one embodiment, the hubs are configured so that the lower surface of each hub can be placed on a support surface. When the legs 124 and 126 are folded upwardly, the ends of the legs 124 and 126 that engage the support surface in the collapsed positions are located above the hubs. In this configuration, the hubs can be placed on a support surface and the support structure 100 can be oriented in a vertical position.

In the illustrated embodiment, the support 110 includes a flexible side wall 112 that defines a cavity 118 in which an infant can be placed and supported. The side wall 112 can be collapsed when the support structure 100 is collapsed and legs 124 and 126 are moved into their collapsed positions. The side wall 112 extends around the perimeter of the support 110. The support 110 and the frame 120 include a first side 113 and an opposite second side 114. The support 110 also includes an upper edge 116 that extends around the perimeter of the support 110.

In the illustrated embodiment, the infant support structure 100 includes a display portion 130 that is couple to the support 110. The display portion 130 is a conventional flexible canopy that is pivotally coupled to the support 110. The display portion 130 can be disposed in a collapsed configuration as shown in FIG. 4 and in extended configurations in which display portion 130 covers a portion of the support 110 as shown in FIG. 3. In alternative embodiments, the display portion can be any structure that can be placed over a portion of the support 110.

Display portion 130 includes an upper end 132 and a lower end 134. The display portion 130 also includes mounting points 136 and 138 at which the display portion 130 is pivotally coupled to the support 10. The mounting points 136 and 138 are located proximate to coupling locations 117 and 119 on the support 110.

The display portion 130 includes rigid or substantially rigid members that can be coupled to the support 10. Conventional fasteners such as screws or rivets can be used to couple the display portion members to the support 110 in a conventional manner.

The display portion 130 includes an inner or display surface 140. In the illustrated embodiment, the display surface 140 is made from a non-reflective material, such as nylon or other fabric. As illustrated in FIG. 3, the display surface 140 includes several discrete reflectors or reflective surfaces 160, 162, and 164.

In alternative embodiments, the display surface 140 may include any number of reflectors that may be spaced at varying distances away from each other. While the reflectors 160, 162, and 164 are illustrated as being circular, the reflectors may have any configuration, size or shape. Moreover, all of the reflectors need not have the same configuration, size or shape.

In the illustrated embodiment, the infant support structure 100 includes light generating mechanisms 150 and 152. Each of the light generating mechanisms 150 and 152 includes one or more light sources. Each light source is directed upwardly toward the display surface 140. In one embodiment, the light generating mechanisms 150 and 152 are disposed proximate to the coupling locations 117 and 119, respectively.

Figure 5:
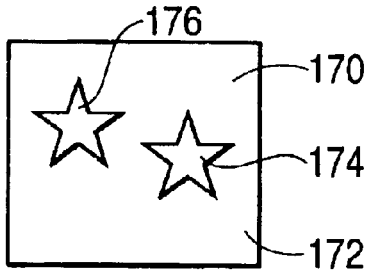
FIG. 5 illustrates a front view of a display portion according to the present invention.

A portion of another embodiment of a display surface is illustrated in FIG. 5. In this embodiment, display surface 170 includes a non-reflective background portion 172 and several reflectors 174 and 176 disposed on the background portion 172. The background portion 172 is a non-reflective surface, such as a flexible, cloth-like material. As illustrated, each of the reflectors 174 and 176 is star-shaped.

Figure 6:
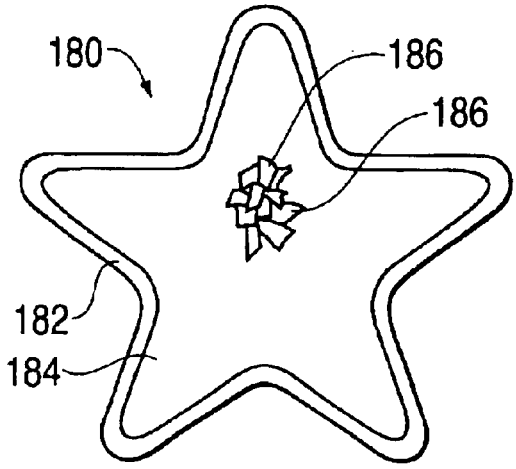
FIG. 6 illustrates a front view of an embodiment of a reflector according to the present invention.

Another embodiment of a reflector is illustrated in FIG. 6. Reflector 180 includes a background layer 182 and a reflective layer 184. A thin plastic or laminate material can be provided over the reflective layer 184. In one embodiment, the laminate material can include sparkles embedded therein.

In the illustrated embodiment, the reflective layer 184 is a print-treated polyester material that has metalized images printed thereon. The reflective layer 184 can be referred to as a holographic film.

The reflective layer 184 includes several reflective or holographic elements 186 that are printed on the reflective layer 184. The elements 186 are printed so that they reflect light at different angles. As a result, light incident on the reflective layer 184 reflects off some, but not all, of the holographic elements 186. As a user's point of view of the reflective layer 184 changes, different combinations of holographic elements 186 reflect light. In one embodiment, the holographic elements 186 can reflect light across the spectrum as a user moves relative to the elements 186. The particular color reflected depends on the angle at which the reflective layer 184 is viewed.

In one embodiment, the holographic elements 186 cover the entire reflective layer 184. In alternative embodiments, the holographic elements 186 only cover a portion of the reflective layer 184.

Figure 7:
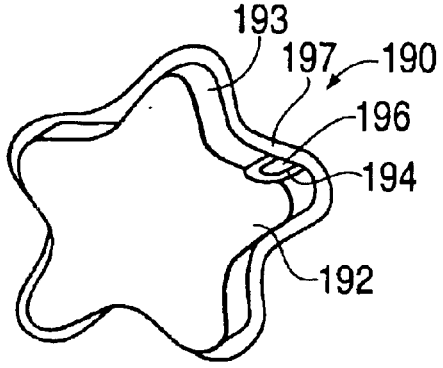
FIG. 7 illustrates a front perspective view of an embodiment of a light generating mechanism according to the present invention.
Figure 8:
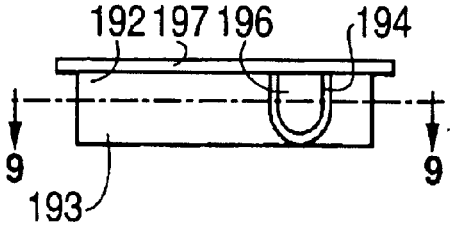
FIG. 8 illustrates a top view of the light generating mechanism of FIG. 7.
Figure 9:
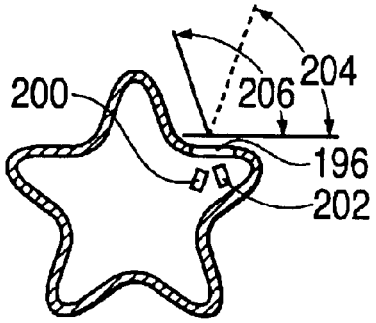
FIG. 9 illustrates a cross-sectional front view of the light generating mechanism of FIG. 7 taken along the lines 9—9 in FIG. 8.

An embodiment of a light generating mechanism is illustrated in FIGS. 7–9. The light generating mechanism includes a housing 190 that is formed in a star-shaped configuration. The housing 190 includes a body 192 and a mounting plate 197. The mounting plate 197 is coupled to the support 110 in any conventional manner.

The body 192 includes an outer perimeter 193 and an opening 194 located along a portion of the perimeter 193. The opening 194 extends through the body 192 into the interior of the housing 190. A transparent lens or cover 196 is location in the opening 194. The lens 196 may be plastic or any other transparent or semi-transparent material.

Some of the internal components of the light generating mechanism are illustrated in FIG. 9. The housing 190 includes light sources 200 and 202. Other components such as a power source and circuitry are also disposed in housing 190, but for simplicity of illustration are not illustrated here.

As illustrated in FIG. 9, light sources 200 and 202 are disposed proximate to the lens 196. Light sources 200 and 202 are oriented to direct light through the lens 196 toward the display surface 140, and in particular, toward one or more of the reflective surfaces on the display surface 140.

In the illustrated embodiment, light source 200 is oriented at an angle 204 with respect to a horizontal plane. Light source 202 is oriented at an angle 206 with respect to the same horizontal plane. In one embodiment, angles 204 and 206 are different, and as a result, light sources 200 and 202 direct light toward different portions of the display surface 140. The light sources 200 and 202 are oriented at different angles with respect to the display surface 140 of the display portion 130. Based on the particular orientations of the light sources 200 and 202, the generated light is incident upon different reflectors, thereby creating different visual experiences.

The light generated by the light sources can be controlled by the processor. In one embodiment, the intensity of light generated by each light source can be varied. Also, the illumination of each light source can be controlled. For example, the light sources can be turned on and off in a particular pattern, at a particular frequency, or randomly.

In one embodiment, the light sources of each light generating mechanism can be operated independently. For example, one light source in a light generating mechanism can be illuminated while the other light source in the light generating mechanism is not illuminated. Also, both light sources in a light generating mechanism can be illuminated simultaneously. The light sources in multiple light generating mechanisms can be controlled so that the operate in a particular pattern, such as sequentially, or operate simultaneously or alternatively with respect to each other.

Now the operation of the infant support structure is described. In the illustrated embodiment, the infant support structure 100 has several modes of operation. Each mode of operation may be for a predetermined amount of time. For example, a mode may last a period of ten minutes.

The output generating system includes several different types of musical outputs, such as songs. In one embodiment, a series of songs can be stored in the memory. The output generating mechanism cycles through the songs in the list.

A first mode of operation of the infant support structure 100 is an active mode. In this mode, music with an upbeat or fast tempo is played. The light sources flash on and off in a pattern that matches the tempo of the music. In this mode, the processor controls the light sources so that the generated light is bright. When the light sources are turned on and off, the reflection of the generated light from the reflectors creates the image of twinkling stars.

A second mode of operation of the infant support structure 100 is a soothing mode with lights. In this mode, soothing music is played. The light sources flash in a pattern that matches the tempo of the soothing music. The light sources flash at a slower rate in this mode than in the first mode. The processor controls the light sources so that the generated light is dimmer than the light generated in the first mode of operation.

A third mode of operation of the infant support structure 100 is a soothing mode without lights. This mode is similar to the second mode with the exception of the generation of lights.

In alternative embodiments, the types and characteristics of the audible outputs, such as music and sound effects, can vary.

In alternative embodiments, the infant support structure may include any number of light generating mechanisms. Similarly, each light generating mechanism can include any number of light sources. The location and orientation of each light generating mechanism can vary depending on the desired light pattern.

In alternative embodiments, the light sources can be used with different colored lens to provide light outputs in different colors. Also, the angles of the light sources can be adjusted to produce light that is incident on the display portion at any angle.

In one embodiment, toys may be suspended from a portion of the infant support structure to entertain an infant.

In an alternative embodiment, the hubs may include recesses that can be used as handles to facilitate the transportation of the support structure.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. An infant support structure comprising:

a support, said support being configured to support an infant;

a canopy, said canopy being pivotally coupled to said support, said canopy being disposable above a portion of said support, said canopy having an inner surface having a non-reflective background and said inner surface having a plurality of discrete reflective surfaces; and an output generating system said output generating system including a light generating mechanism coupled to said support, said light generating mechanism being directed toward said canopy inner surface.

2. The infant support structure of claim 1, said light generating mechanism including a first light source and a second light source, said first light source being oriented at a first angle with respect to said canopy inner surface, said second light source being oriented at a second angle with respect to said canopy inner surface, said first angle being different than said second angle.

3. The infant support structure of claim 2, said first light source being generally directed toward one of said plurality of reflective surfaces, and said second light source being generally directed toward another of said plurality of reflective surfaces.

4. An infant support structure comprising:

a support, said support being configured to support an infant;

a canopy, said canopy being movably coupled to said support, said canopy being disposable above a portion of said support, said canopy having an inner surface having a non-reflective background and a plurality of discrete reflective surfaces; and an output generating system, said output generating system including a light generating mechanism coupled to said support, said light generating mechanism being directed toward said canopy inner surface, at least one of said reflective surfaces including a holographic element.

5. The infant support structure of claim 1, each of said plurality of reflective surfaces including a plurality of holographic elements.

6. An infant support structure comprising:

a support, said support being configured to support an infant;

a canopy, said canopy being movably coupled to said support, said canopy being disposable above a portion of said support, said canopy having an inner surface having a non-reflective background and said inner surface having a plurality of discrete reflective surfaces; and an output generating system, said output generating system including a light generating mechanism coupled to said support, said light generating mechanism being directed toward said canopy inner surface, said output generating system including a processor and an audible output generating mechanism, said processor being configured to control said light generating mechanism and to control outputs from said audible output generating mechanism.

7. The infant support structure of claim 1, said canopy being flexible and at least one of said plurality of reflective surfaces being a holographic film.

8. The infant support structure of claim 1, each of said plurality of reflective surfaces being a holographic film that includes a plurality of holographic elements and having a configuration resembling a star.

9. An infant entertainment device comprising:

a frame, said frame configured to support an infant;

a display component, said display component being coupled to said frame and having a display surface;

a plurality of light reflective elements, said plurality of light reflective elements being disposed on said display surface, each of said plurality of light reflective elements including a holographic element; and a light source, said light source being configured to illuminate said holographic elements on said display surface.

10. The infant entertainment device of claim 9, said display surface being curved.

11. The infant entertainment device of claim 9, said display component being movable relative to said frame.

12. The infant entertainment device of claim 9, said display component being a collapsible canopy.

13. The infant entertainment device of claim 9, said frame being an infant bassinet and said display component being a collapsible canopy pivotally coupled to said infant bassinet.

14. The infant entertainment device of claim 9, said display component being coupled to said frame at a coupling location, said light source being disposed proximate to said coupling location.

15. The infant entertainment device of claim 9, said light source being a first light source, said infant entertainment device further comprising:

a second light source, each of said first light source and said second light source being directed toward said display surface of said display component.

16. The infant entertainment device of claim 15, said display component being coupled to said frame at a first coupling location and at a second coupling location, said first light source being disposed proximate to said first coupling location, and said second light source being disposed proximate to said second coupling location.

17. The infant entertainment device of claim 16, said frame including a first side and a second side opposite said first side, said first coupling location being located proximate to said frame first side, said second coupling location being located proximate to said frame second side.

18. The infant entertainment device of claim 16, said display component being a canopy configured to pivot about said first coupling location and said second coupling location.

19. The infant entertainment device of claim 9, said light source including a housing defining an opening, a lens disposed proximate to said opening, and a bulb disposed in said housing and oriented to project light through said lens.

20. The infant entertainment device of claim 9, further comprising:

an output system, said output system including a controller and an output device, said controller being configured to control the intensity of light illuminated from said light source and outputs generated by said output device.

21. A method of simulating the twinkling of stars on an infant support structure, the infant support structure including a frame and a display portion mounted for movement between a collapsed configuration and an extended configuration in which the display portion covers a portion of the support structure, and a light source coupled to the frame, the display portion including a surface having a first reflector and a second reflector disposed thereon, said method comprising:

moving the display portion from the collapsed configuration to the extended configuration;

directing a first light output from the light source toward the first reflector and the second reflector on the display portion surface; and directing a second light output from the light source toward the first reflector and the second reflector on the display portion surface, the first light output being different than the second light output, thereby generating the appearance of the twinkling of the first reflector and the second reflector.

22. The method of claim 21, the light source including a first bulb and a second bulb, the first bulb being oriented at a first angle relative to said display portion surface, the second bulb being oriented at a second angle relative to said display portion surface, the first angle being different than said second angle.

23. A method of simulating the twinkling of stars on an infant support structure, the infant support structure including a frame and a display portion, and a light source coupled to the frame, the light source including a first bulb and a second bulb, the display portion including a surface having a first reflector and a second reflector disposed thereon, said method comprising:

directing a first light output from the light source toward the first reflector and the second reflector on the display portion surface by illuminating only the first bulb of the light source; and directing a second light output from the light source toward the first reflector and the second reflector on the display portion surface by illuminating only the second bulb of the light source.

24. The method of claim 21, the first light output being in a first direction relative to the display portion surface, the second light output being in a second direction relative to the display portion surface, the first direction being different than the second direction.

25. A method of simulating the twinkling of stars on an infant support structure, the infant support structure including a frame having a display portion, and a light source coupled to the frame, the display portion including a surface having a first reflector and a second reflector disposed thereon, said method comprising:

directing a first light output from the light source toward the first reflector and the second reflector on the display portion surface; and directing a second light output from the light source toward the first reflector and the second reflector on the display portion surface, the first light output being different than the second light output, thereby generating the appearance of the twinkling of the first reflector and the second reflector, each of the first reflector and the second reflector including a plurality of holographic elements.

26. The method of claim 21, each of the first reflector and the second reflector being a holographic film and having a configuration resembling a star.

27. A method of simulating the twinkling of stars on an infant support structure, the infant support structure including a frame having a display portion, and a light source coupled to the frame, the display portion including a surface having a first reflector and a second reflector disposed thereon, said method comprising:

directing a first light output from the light source toward the first reflector and the second reflector on the display portion surface; and directing a second light output from the light source toward the first reflector and the second reflector on the display portion surface, the first light output being different than the second light output, thereby generating the appearance of the twinkling of the first reflector and the second reflector, said directing second light output occurring after said directing a first light output.

28. The method of claim 21, the light source being a first light source, the first light source being located on a first side of the frame, and the infant support structure including a second light source being located on a second side of the frame, the method further comprising:

directing a third light output from the second light source toward the first reflector and the second reflector; and directing a fourth light output from the second light source toward the first reflector and the second reflector, the third light output being different than the fourth light output.

29. The method of claim 28, said directing a third light output occurring substantially simultaneously with said directing a first light output.

30. The method of claim 29, said directing a fourth light output occurring substantially simultaneously with said directing a second light output.

31. An infant support structure comprising:

a support, said support being configured to support an infant, said support including a first side and a second side opposite said first side;

a canopy, said canopy being coupled to said support at a first location on said support first side and at a second location on said support second side, said canopy including an inner surface having a first reflective portion, a second reflective portion, and a third reflective portion, each of said second reflective portion and said third reflective portion including at least one holographic element and being more reflective than said first reflective portion, said first reflective portion being located between said second reflective portion and said third reflective portion on said inner surface; and an output generating system, said output generating system including a processor, an audible output generating mechanism, a first light source, and a second light source, said first light source being coupled to said support proximate to said first location, said second light source being coupled to said support proximate to said second location, said first light source being configured to illuminate said inner surface, said second light source being configured to illuminate said inner surface, and said processor being configured to control said first light source and said second light source in accordance with outputs from said audible output generating mechanism.

32. The infant support structure of claim 31, each of said first light source and said second light source including a housing defining an opening, a lens disposed proximate to said opening, and a bulb disposed in said housing and oriented to project light through said lens.

33. An infant support structure comprising:

a support;

a cover, said cover movably coupled to said support for movement between a collapsed configuration and an extended configuration in which said cover covers a portion of said support, said cover including a background portion and a plurality of reflectors disposed on said background portion; and first and second light generating mechanisms, said first and second light generating mechanisms being oriented to direct light onto said background portion.

34. The infant support structure of claim 33, each of said plurality of reflectors including a holographic element.

35. The infant support structure of claim 33, each of said first and second light generating mechanisms including first light source and a second light source.

36. The infant support structure of claim 33, said cover being coupled to said support at a first location and at a second location, said first light generating mechanism being proximate to said first location, and said second light generating mechanism being proximate to said second location.

37. The infant support structure of claim 33, said support being and infant bassinet, said cover being a canopy, and each of said plurality of reflectors being a holographic film with a plurality of holographic elements.

38. The infant support structure of claim 1, said portion of said support being a first portion of said support, said canopy being disposable over a second portion of said support, said first portion of said support being distinct from said second portion of said support.

39. The infant support structure of claim 1, said canopy being collapsible.

40. The infant support structure of claim 1, said canopy being constructed substantially of fabric.

* * * * *